United States Patent [19]

Olsen

[11] Patent Number: 4,597,235

[45] **Date of Patent: * Jul. 1, 1986**

[54] PANEL WALL SYSTEM

[75] Inventor: Robert W. Olsen, New Providence, N.J.

[73] Assignee: Construction Specialties, Inc., Cranford, N.J.

[ * ] Notice: The portion of the term of this patent subsequent to Mar. 26, 2002 has been disclaimed.

[21] Appl. No.: 669,585

[22] Filed: Nov. 8, 1984

[51] Int. Cl.[4] ..... E04B 1/38

[52] U.S. Cl. ..... 52/509; 52/489; 52/762; 52/775

[58] Field of Search ..... 52/489, 509, 512, 762, 52/772, 774, 775

[56] References Cited

U.S. PATENT DOCUMENTS 4,506,484 3/1985 Bartlett et al. ..... 52/489 X

*Primary Examiner*—William F. Pate, III
*Assistant Examiner*—Creighton Smith
*Attorney, Agent, or Firm*—Brumbaugh, Graves, Donohue & Raymond

[57] ABSTRACT

An exterior panel wall assembly comprises a multiplicity of pan-like rectangular panels arranged in closely spaced relation side by side and end to end and joined to a horizontal retainer that is, in turn, fastened to the building structure at the horizontal junctures between side by side pairs of vertically adjacent panels. Each horizontal retainer has a drainage trough for conducting water to the end of the retainer, and a drainage channel member is located at the vertical juncture between each pair of horizontally adjacent panels.

6 Claims, 4 Drawing Figures

PANEL WALL SYSTEM

FIELD OF THE INVENTION

The present invention relates to a panel wall system and, in particular, a wall cladding system that is especially suitable for use in commercial and industrial buildings.

BACKGROUND OF THE INVENTION

There are, of course, many ways of finishing the exteriors of commercial and industrial buildings. One type of external wall system utilizes individual prefabricated panels that are suitably fastened to the building framing, ordinarily by a relatively lightweight retaining system to which the panels can readily be attached and by which the panels are joined to the main building framing. Within this general type of exterior panel wall system are some commercially available versions that utilize composite panels composed of thin aluminum sheets laminated to a plastic core. These composite panels fit into a frame work made up of retainers having grooves that receive the edges of the panels.

These previously known panel systems based on aluminum/plastic/aluminum composite panels have several disadvantages. For one thing the framing system ordinarily requires that the panels and retainers be installed in step, panel by panel and retainer by retainer, working horizontally and vertically, inasmuch as the system depends upon reception of the panel edges in channels or tracks of the retainers. Thus, after a panel is installed, the retainer tracks for the then free edges of the panel are installed and so forth. As far as installation costs are concerned, the assembly procedure is relatively inexpensive and can be accomplished relatively quickly. On the other hand, there is a distinct disadvantage that any panels that might be damaged during the life of the building are difficult to replace. Moreover, the composite panels have shown a tendency to delaminate because of deterioration of the adhesives due to the effect of moisture that attacks the edges where they fit into the retainers.

An exterior building wall panel system should protect the building structure from intrusion of water but also allow the wall to breathe. These two desired characteristics conflict to some degree and are difficult to attain with relatively large panels, because thermal expansion and contraction of the panels is hard on any sealing system. It is quite possible that seals will leak, sometimes as a result of careless installation or, perhaps more commonly, as a result of wear and tear from hundreds or thousands of thermal cycles over a period of years. Water intrusion behind the panel faces due to condensation is inevitable under certain weather conditions.

Construction Specialties, Inc. ("C/S"), the assignee of the present invention, has previously developed and commercialized a wall panel system under the trademark "Techwall" that has numerous advantages over the ones described generally above. Reference may be made to Goertner U.S. patent application Ser. No. 458,540, filed Jan. 17, 1983, and entitled "Panel Wall System" and Bartlett et. al. U.S. Pat. No. 4,506,484, issued Mar. 26, 1985 and entitled "Panel Wall System" for a complete description of the prior art C/S "Techwall" system. The "Techwall" system employs vertical and horizontal retainers that are fastened to the building structure and to which panlike rectangular panels are fastened by clips received in slots in the peripheral flanges and fastened to the retainers. The Goertner application is directed to the panel form and the fastening arrangement. The Bartlett et. al. application discloses a system that employs the concepts of the Goertner panels and fastener clips and provides for water control and drainage and to adapt the Goertner system to the "rain screen" principle of building construction. The "Techwall" system fulfills the objectives referred to above of protecting the building from water intrusion while allowing the wall to breathe and also provides for control and drainage of any water that penetrates the panel facade.

SUMMARY OF THE INVENTION

There is provided, in accordance with the present invention an exterior panel wall assembly comprising a multiplicity of rectangular panels arranged in closely spaced relation side by side and end to end. Each panel is of panlike shape in that it consists of a principal wall forming a portion of the exterior building wall and a continuous peripheral flange extending inwardly from the perimeter of the principal wall toward the building structure. A horizontal retainer is fastened to the building structure at the horizontal juncture between each pair of vertically adjacent panels, and each panel is fastened to the horizontal retainer by clips spaced at suitable intervals. A drainage channel member is located at the vertical juncture between each pair of horizontally adjacent panels, each drainage channel member being coextensive with the vertical portions of the peripheral flanges of the respective panels and having a base portion and flanges along each edge of the base portion extending away from the building structure toward the panels and spaced apart laterally outwardly of the junctions between the vertical portions of the peripheral flanges. Each retainer has a drainage trough extending coextensively with the horizontal juncture between the vertically adjacent panels and communicating with a drainage channel member, whereby water intruding behind the panels is conducted horizontally by the drainage troughs and vertically by the drainage channel members for controlled flow and for collection and removal to the exterior of the building.

In a preferred embodiment of the invention each horizontal retainer is coextensive with at least two horizontally side by side pairs of vertically adjacent panels, and an intermediate drainage channel member is located at the vertical juncture between the upper panels of said pairs and communicates at its lower end with the drainage trough of the horizontal retainer. A primary drainage channel member extends coextensively with said pairs of panels at each end of the retainer, the ends of the drainage trough of the retainer opening to each primary drainage channel member. Preferably, each intermediate drainage channel member is fastened to the horizontal retainers above and below the upper panels of said pairs of panels and the primary drainage channel members are fastened to the building structure.

For a better understanding of the invention reference may be made to the following description of an exemplary embodiment, taken in conjunction with the figures of the accompanying drawing.

DESCRIPTION OF THE EMBODIMENT

Figure 1:
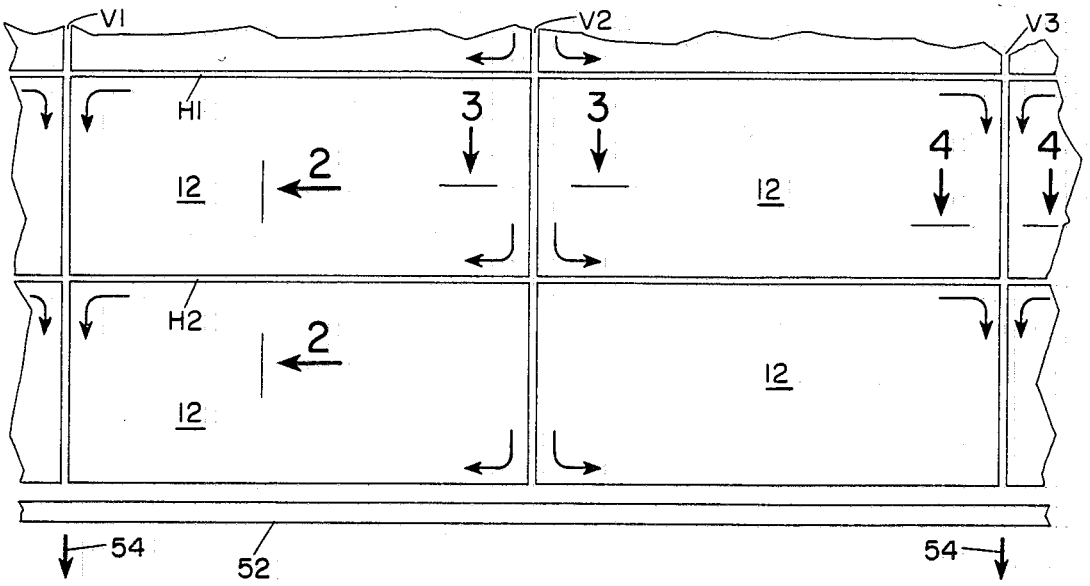
FIG. 1 is a front elevational view in generally schematic form of a representative cluster of panels of the embodiment.

In a preferred embodiment of the present invention the exterior facade of a building at locations other than windows or other openings or special treatments is provided by the principal walls 10 of a multiplicity of pan-like rectangular panels, which are designated generally by the reference numeral 12. Each panel has a continuous peripheral flange 14 that extends in from the principal wall toward the building structure. A suitable panel is made from a sheet of aluminum of a thickness of $\frac{1}{8}''$ notched at each corner and formed to provide the flanges, the flanges being welded and ground at each corner so otherwise sealed to present a peripherally continuous flange and to render the panel of pan-like configuration. Internal stiffeners can be used to impart rigidity to the principal wall in the case of relatively large panels. The panels can also be fabricated from other materials by various techniques, such as die-formed or drawn steel, thermo-formed or molded plastic or laminated metal or plastic sheets with suitable core materials.

Figure 2:
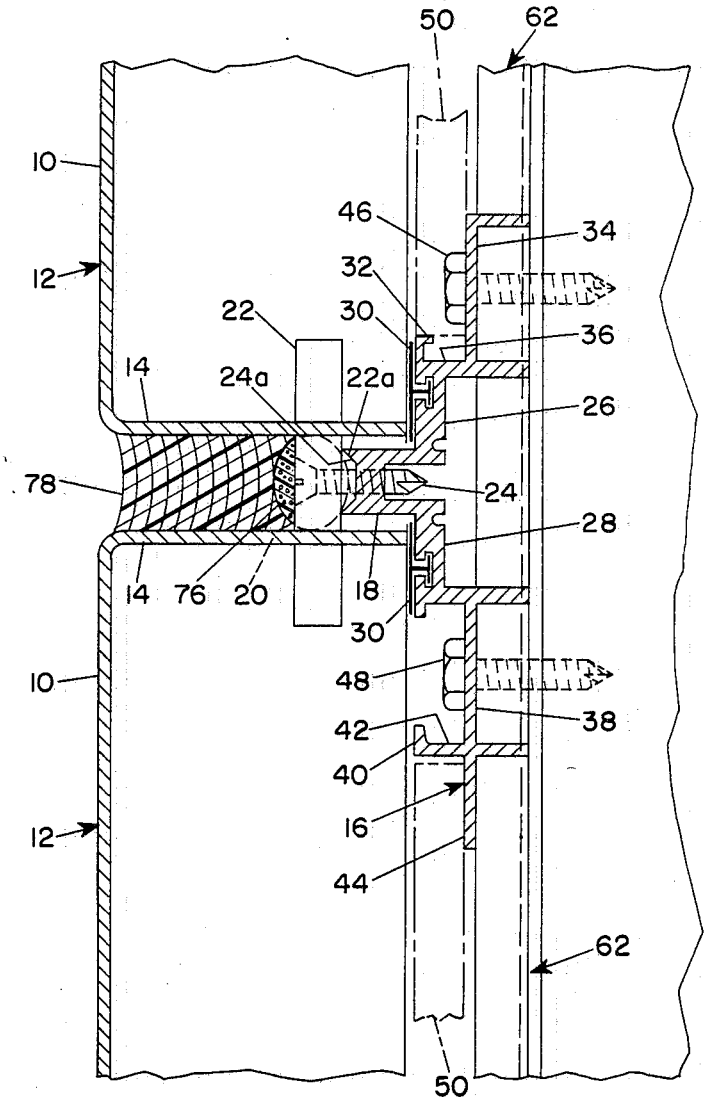
FIG. 2 is an end cross-sectional view taken at a horizontal juncture between a vertically adjacent pair of panels, as indicated by the arrowed lines 2—2 in FIG. 1.

The adjacent horizontal portions of each flange 14 along the juncture between each vertically adjacent pair of panels are joined to the building structure by a horizontal retainer 16, a cross-sectional view of which appears in FIG. 2. Each horizontal retainer 16 comprises a medial portion 18 that protrudes a short distance into the juncture between the flanges 14. Each horizontal flange portion has slots 20 (see FIG. 4) cut into it at suitable intervals, say 16″ or 24″, and a mounting clip is installed in the slots and fastened by a screw 24 to the medial portion 18 of the retainer. Each clip is installed by aligning it initially to lie lengthwise of the juncture between the panels (i.e., horizontally) and then rotating it 90° into the installed position. A key portion 22A of the clip fits into a keyway 24A to securely position the clip 22 in the installed position. Reference may be made to the Geartner application identified above for a more detailed description and illustration of the mounting clip of the present embodiment. The present invention may be employed with other fastening arrangements, but the mounting clips of FIG. 2 offer the advantages of being of simple construction, easy to install and permit each individual panel to be removed for repair or replacement, should there ever be a need to do so.

The retainer 16 further comprises an upper landing flange portion 26 and a lower landing flange portion 28 above and below, respectively, the medial portion 18, each presenting a landing surface for the edge of the respective horizontal flange portion of the panel and receiving a suitable sealing gasket 30 for providing a reasonably effective water seal between the edge of the horizontal flange and the retainer.

Immediately above the upper landing flange 26 is a segment of channel-shaped cross-section defined, in part, by a rib 32 and by the lower portion of a channel-shaped upper mounting flange portion 34. The aforementioned channel-shaped segment of the retainer cross-section constitutes an upper drainage trough 36. A lower channel-shaped mounting flange portion 38 is joined to the lower landing flange portion 28. An L-shaped rib 40 extends outwardly from the lower part of the lower mounting flange portion 38 and defines a lower drainage trough 42. A flange 44 extends downwardly from the lower mounting flange portion 38 and serves a purpose that is described below.

The retainer is preferably made from aluminum by extrusion and has a uniform cross-section along its length. It is fastened at suitable intervals along its length to the building structure by fasteners 46 and 48 that extend through the mounting flange portions 34 and 38. The retainers can also be fastened to the structure by screws extending through the medial portion 18.

Figure 3:
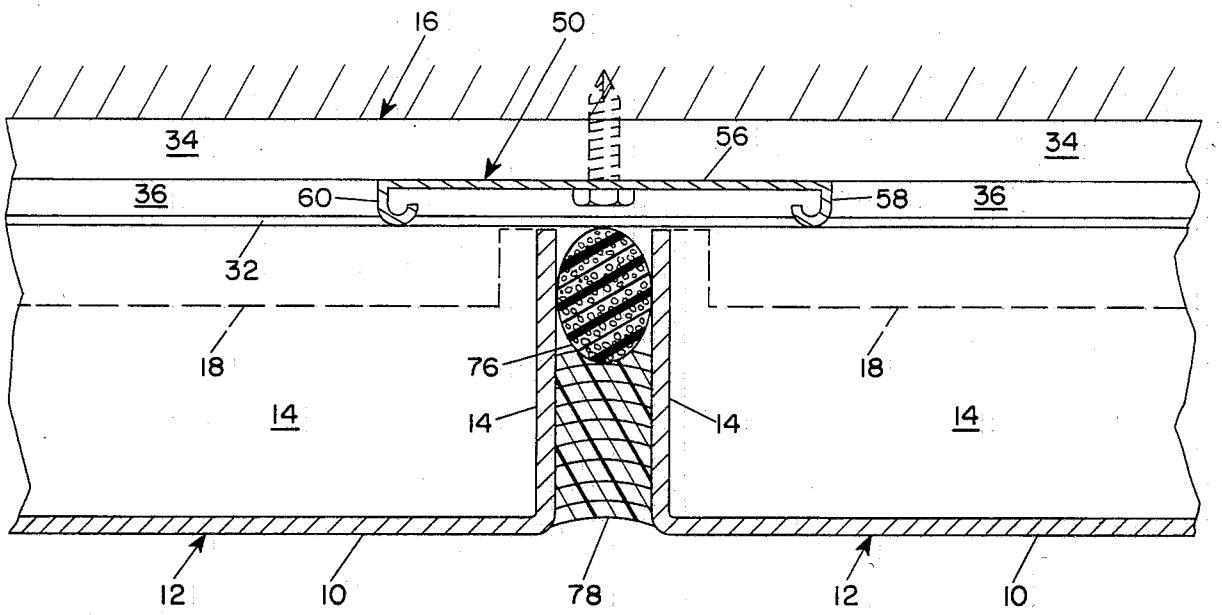
FIG. 3 is a cross-sectional view taken at a vertical juncture between horizontally adjacent panels, as indicated by the arrowed lines 3—3 of FIG. 1.

The vertical portions of the peripheral flanges 14 of the respective panels 10 are not fastened in any way to the building structure, nor is there any sealing arrangement between the ends of the vertical flanges and any other element. Instead a vertical drainage channel is installed at each vertical juncture between horizontally adjacent pairs of panels. Two types of drainage channels are used, although an identical extruded aluminum profile can be used for both types. As shown in FIG. 3 one of the two types of drainage channel member is an intermediate drainage channel member 50. More particularly each horizontal retainer may have a length of up to approximately 20′. In such a case there will be two or more pairs of horizontally adjacent panels positioned end-to-end and joined to the particular horizontal retainer, and the horizontal retainer will extend continuously across the vertical juncture between the horizontally adjacent panels. FIG. 1 depicts such an arrangement schematically. The vertical junctures between horizontally adjacent panels are designated V1, V2 and V3, and the horizontal junctures are designated H1 and H2. The horizontal retainers in this example extend continuously from vertical juncture V1 across the juncture V2 to the vertical juncture V3, there being one horizontal retainer at the horizontal juncture H1 and another horizontal retainer at the juncture H2.

In FIG. 1 the lower termination of a group of panels (e.g., at the building foundation or over windows) is depicted by the representation of a horizontal drainage channel 52 underlying the lowest row of panels in the group for collecting any water in the drainage system of the panel assembly and suitably arranged for conducting the water away, as represented schematically by the arrows 54. The lower horizontal flanges 14 of the lower most panels in the group can be joined to the building structure by brackets and clips, as described and shown in the Bartlett et al. application referred to above.

In the representative group shown in FIG. 1, an intermediate drainage channel member extends vertically at the juncture V2 between the two horizontal retainers and also from the lower retainer at juncture H2 downwardly to the collection channel 52. Each intermediate drainage channel member 50 comprises a base portion 56 and an edge flange portion 58 and 60 along each edge of the base portion (see FIG. 3). The flange portions 58 and 60 lie laterally outwardly some distance from the vertical flange portions 14 of the respective panels relative to the gap between them. The phantom lines in FIG. 2 indicate the location of the intermediate drainage channel members 50 where they meet the horizontal retainers. The flange 44 provides a landing area for the upper end of a channel member 50, and the channel member is fastened by a screw to the flange 44. The landing area for the lower end of each intermediate drainage channel member 50 is the external or outwardly facing wall of the upper mounting flange portion 34, and a screw is used to fasten the lower end of the channel member 50 to the mounting flange portion.

Figure 4:
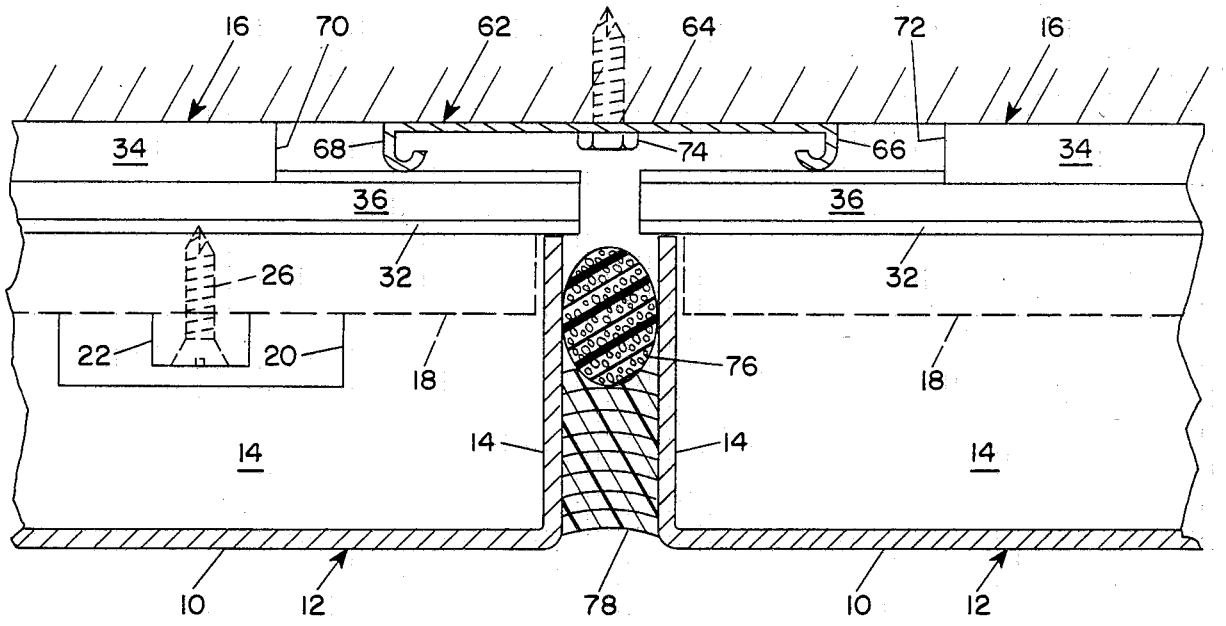
FIG. 4 is a cross-sectional view taken at the vertical juncture between a pair of horizontally adjacent panels, as represented by the arrowed lines 4—4 in FIG. 1.

The other form of drainage channel member is the primary vertical drainage channel member 62 shown in FIG. 4. The member 62 is used at each vertical juncture between panels at the ends of horizontally adjacent retainers. In the example of FIG. 1, a member 62 is installed at each of the vertical junctures V1 and V3. Each primary drainage channel member 62 extends vertically over the entire vertical extent of a cluster of panels. Each primary vertical drainage channel member comprises a base portion 64 and a flange portion 66 and 68 along each edge of the base portion (see FIG. 4), the respective flange portions lying laterally outwardly of the vertical juncture between the panels. To accommodate each primary vertical drainage channel member, the legs of the upper and lower mounting flange portions 34 and 38 are notched out at notched portions 70 and 72 (see FIG. 4), and the members 62 are fastened directly to the building structure by screws 74 at suitable vertical intervals. The channel members can, alternatively, be fastened to the horizontal retainers.

The small gaps between the adjacent horizontal and vertical flange portions at the junctures between adjacent panels are sealed by installing a backer rod 76 and filling the outer portion of the gap with an elastomeric sealant 78.

Regardless of the quality of workmanship and the type of elastomeric sealant, it is virtually certain that sooner or later in the life of the building face, break-throughs in the sealing system will occur. Moreover, condensation on the inner surfaces of the panels will inevitably occur. The present invention provides for minimizing the penetration of water from the external face of the bulding into the space between the panels and the building structure and provides for control and removal of water that intrudes between the panel system and the building structure as a result of either condensation or break-through of the sealant 78.

Intrusion of water through break-throughs in the sealant system is minimized by providing breathability in the panel system so that the external pressure on the building wall and the pressure in the space between the panel system and the building structure are maintained substantially equal under all conditions. The drainage channel provides for vertical communication of the space between the panel faces and the building, and both the primary and intermediate channel members 50 and 62 are in open communincation with the spaces defined by the principal walls 10 and flanges 14 of the panels 12 as well the drainage troughs 36 and 42. Water penetration at the horizontal junctures between panels as well as condensate on the inner surfaces of the panels will tend to be caught by the sealing members 30 and run to one or the other end of a horizontal flange portion, from which it will then flow vertically down the respective drainage channel member. Water that penetrates through the vertical juncture between adjacent panels will likewise be controlled and drained away by a primary or intermediate drainage channel member. In the case of the intermediate drainage channel members, they communicate at their lower ends with the upper horizontal drainage trough 36 of the horizontal retainer, and water discharged at this point will flow along the upper drainage trough 36 and be discharged from the trough to a primary drainage channel member.

The arrows adjacent the vertical juncture V2 in FIG. 1 illustrate the water drainage from the intermediate drainage channel members to the drainage troughs of the horizontal retainers. The arrowed lines adjacent the junctures V1 and V3 represent the discharge of water from the drainage troughs of each horizontal retainer to the primary drainage channel members. As described previously, the water discharged from the lower end of each drainage channel member is removed through weepholes or piping in a collector channel, as represented schematically by the arrowed lines 54. It can also be discharged onto flashing rather than a collector channel.

I claim:

1. An exterior panel wall assembly comprising a multiplicity of rectangular panels arranged in closely spaced relation side by side and end to end, each panel being of pan-like shape and consisting of a principal wall forming a portion of an exterior building wall and a continuous peripheral flange extending from the principal wall toward the building structure, a horizontal retainer fastened to the building structure and coextensive with the horizontal juncture between each pair of vertically adjacent panels, fastening means joining each horizontally extending flange of each pair of vertically adjacent panels to the corresponding horizontal retainer, and a drainage channel member located at the vertical juncture between each pair of horizontally adjacent panels, each drainage channel member being coextensive with the vertical portions of the peripheral flanges of the respective panels at said vertical juncture and having a base portion and flanges along each edge of the base portion extending away from the building structure toward the panels and spaced-apart laterally outwardly of the vertical portions of the peripheral flanges of said horizontally adjacent pair of panels relative to the vertical juncture between them, and each horizontal retainer having a drainage trough extending coextensively with the horizontal juncture between said pair of vertically adjacent panels and communicating with a drainage channel member, whereby water intruding behind the panels is conducted horizontally by the drainage troughs and vertically by the drainage channel members for controlled flow and for collection and removal to the exterior of the building.

2. An assembly according to claim 1 wherein each horizontal retainer is coextensive with at least two horizontally side-by-side pairs of vertically adjacent panels, wherein an intermediate drainage channel member is located at the vertical juncture between the upper panels of said pairs and communicates at its lower end with the drainage trough of the horizontal retainer, and a primary drainage channel member extends coextensively with said pairs of panels at each end of the retainer, the ends of the drainage trough of the retainer opening to each primary drainage channel member.

3. An assembly according to claim 2 wherein each intermediate drainage channel member is fastened to the horizontal retainers above and below the upper panels of said pairs of panels.

4. An assembly according to claim 2 wherein the primary drainage channel members are fastened to the building structure.

5. An assembly according to claim 4 wherein each end of the horizontal retainer has a notch that accepts a portion of the corresponding primary drainage channel member and an end portion of the drainage trough of the retainer overlies the corresponding drainage channel member.

6. An assembly according to claim 1 including a gap at the horizontal juncture between the vertically adjacent panels and wherein the horizontal retainer includes a medial portion coextensive with said gap and adapted to receive said fastener means, a landing flange portion generally underlying the horizontal portion of the peripheral flange of each panel that is fastened to it, an upwardly facing channel portion constituting the drainage trough adjacent each landing flange portion and a mounting flange portion outwardly, relative to the medial portion, of each landing flange portion.

* * * * *